US009476566B2

(12) United States Patent
Lu et al.

(10) Patent No.: US 9,476,566 B2
(45) Date of Patent: Oct. 25, 2016

(54) LIGHT FIXTURE WITH TEXTURED REFLECTOR

(75) Inventors: Dong Lu, Cary, NC (US); Nick Hoang Nguyen, Durham, NC (US); John Durkee, Raleigh, NC (US)

(73) Assignee: Cree, Inc., Durham, NC (US)

( * ) Notice: Subject to any disclaimer, the term of this patent is extended or adjusted under 35 U.S.C. 154(b) by 551 days.

(21) Appl. No.: 13/345,215

(22) Filed: Jan. 6, 2012

(65) Prior Publication Data

US 2013/0176721 A1 Jul. 11, 2013

(51) Int. Cl.

| | |
|---|---|
| ***F21V 7/22*** | (2006.01) |
| ***F21V 7/00*** | (2006.01) |
| ***F21V 13/04*** | (2006.01) |
| ***F21V 7/04*** | (2006.01) |
| ***F21V 7/09*** | (2006.01) |
| *F21S 8/06* | (2006.01) |
| *F21V 15/01* | (2006.01) |
| *F21Y 101/02* | (2006.01) |

(Continued)

(52) U.S. Cl.

CPC ..... *F21V 7/0008* (2013.01); *F21V 7/048* (2013.01); *F21V 7/09* (2013.01); *F21V 7/22* (2013.01); *F21V 13/04* (2013.01); *F21S 8/06* (2013.01); *F21V 15/013* (2013.01); *F21V 29/777* (2015.01); *F21Y 2101/02* (2013.01); *F21Y 2113/002* (2013.01); *Y10T 29/4998* (2015.01)

(58) Field of Classification Search

CPC ..... F21V 7/22; F21V 7/00; F21V 7/0008; F21V 7/041; F21V 3/049; F21V 5/02

USPC ..... 362/341–350

See application file for complete search history.

(56) References Cited

U.S. PATENT DOCUMENTS 3,527,933 A * 9/1970 Helmut ..... 362/341
4,829,728 A 5/1989 Castelli et al.

(Continued)

FOREIGN PATENT DOCUMENTS

EP 0813026 A2 12/1997
FR 2135170 12/1972

(Continued)

OTHER PUBLICATIONS

Cree, Inc., International Application No. PCT/US2013/020073, Invitation to Pay Additional Fees, and, Where Applicable, Protest Fee, May 21, 2013.

(Continued)

*Primary Examiner* — William Carter

(74) *Attorney, Agent, or Firm* — Steven B. Phillips; Moore & Van Allen PLLC

(57) ABSTRACT

A light fixture with a textured reflector is disclosed. Embodiments of the present invention provide for a lighting system in which LEDs face, and the majority of light form the LED light source is incident on, a textured back reflector while producing minimal glare and minimal imaging of the light source. Such a reflector may be referred to as a retro-reflector. The reflector for the light fixture can be made from a relatively inexpensive material such as polycarbonate, which without texturing has a specular or semi-specular surface. Further, a diffuse white layer to provide color mixing or prevent glare and reflections is not needed. The textured reflector can be textured by way of an imprinted pattern or by roughening, and can be extruded. A prismatic texture may be used. The texturing can also be spatially varied.

47 Claims, 7 Drawing Sheets

(51) Int. Cl.
*F21Y 113/00* (2016.01)
*F21V 29/77* (2015.01)

(56) References Cited

U.S. PATENT DOCUMENTS

| | | | | |
|---|---|---|---|---|
| 5,688,042 | A | 11/1997 | Madadi et al. | |
| 6,616,305 | B1 * | 9/2003 | Simon | F21V 5/02 362/268 |
| 6,853,151 | B2 | 2/2005 | Leong et al. | |
| 6,860,628 | B2 | 3/2005 | Robertson et al. | |
| 6,936,968 | B2 | 8/2005 | Cross et al. | |
| 7,048,410 | B2 | 5/2006 | Kutler | |
| 7,049,761 | B2 | 5/2006 | Timmermans et al. | |
| 7,114,830 | B2 | 10/2006 | Robertson et al. | |
| 7,229,192 | B2 * | 6/2007 | Mayfield, III | F21S 8/04 362/223 |
| 7,307,391 | B2 | 12/2007 | Shan | |
| 7,510,299 | B2 | 3/2009 | Timmermans et al. | |
| 7,815,338 | B2 | 10/2010 | Siemiet et al. | |
| 7,926,975 | B2 | 4/2011 | Siemiet et al. | |
| 7,976,196 | B2 | 7/2011 | Ivey et al. | |
| 8,058,659 | B2 | 11/2011 | Bisberg | |
| 8,093,823 | B1 | 1/2012 | Ivey et al. | |
| 8,115,411 | B2 | 2/2012 | Shan | |
| 8,118,447 | B2 | 2/2012 | Simon et al. | |
| 8,247,985 | B2 | 8/2012 | Timmermans et al. | |
| 8,282,247 | B2 | 10/2012 | Ivey et al. | |
| 8,324,817 | B2 | 12/2012 | Ivey et al. | |
| 8,360,599 | B2 | 1/2013 | Ivey et al. | |
| 8,362,710 | B2 | 1/2013 | Langovsky | |
| 8,382,327 | B2 | 2/2013 | Timmermans et al. | |
| 8,419,223 | B2 | 4/2013 | Withers | |
| 8,421,366 | B2 | 4/2013 | Palazzolo et al. | |
| 8,449,137 | B2 | 5/2013 | Dassanayake et al. | |
| 8,482,212 | B1 | 7/2013 | Ivey et al. | |
| 8,573,813 | B2 | 11/2013 | Ivey et al. | |
| 8,596,813 | B2 | 12/2013 | Ivey | |
| 8,646,941 | B1 * | 2/2014 | McKenna et al. | 362/235 |
| 2001/0049893 | A1 * | 12/2001 | Maas et al. | 362/31 |
| 2002/0060526 | A1 | 5/2002 | Timmermans et al. | |
| 2004/0042225 | A1 * | 3/2004 | Dealey et al. | 362/487 |
| 2010/0188838 | A1 | 7/2010 | Yajima et al. | |
| 2011/0199005 | A1 * | 8/2011 | Bretschneider et al. | 315/294 |
| 2011/0199769 | A1 | 8/2011 | Bretschneider et al. | |

FOREIGN PATENT DOCUMENTS

| | | | |
|---|---|---|---|
| JP | H08162677 | A | 6/1996 |
| WO | 0071930 | A1 | 11/2000 |
| WO | 0150444 | A1 | 7/2001 |
| WO | 2005055328 | A1 | 6/2005 |
| WO | 2008146229 | A2 | 12/2008 |
| WO | 2010099755 | A1 | 9/2010 |
| WO | 2011140353 | A2 | 11/2011 |

OTHER PUBLICATIONS

Cree, Inc., International Application No. PCT/US2013/020073, International Search Report and Written Opinion, May 14, 2013.
U.S. Appl. No. 29/467,949, filed Sep. 25, 2013.
U.S. Appl. No. 13/943,152, filed Jul. 16, 2013.
European Patent Office; Office Action for European Patent Application No. 13702268.7 dated Oct. 1, 2015, 7 Pages.

* cited by examiner

LIGHT FIXTURE WITH TEXTURED REFLECTOR

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. In many applications, one or more LED dies (or chips) are mounted within an LED package or on an LED module, which may make up part of a lighting unit, lamp, "light fixture" or more simply a "fixture," which includes one or more power supplies to power the LEDs. An LED fixture may be made with a form factor that allows it to replace a standard fixture or bulb. LEDs can also be used in place of florescent lights as backlights for displays.

For most LED lamps and fixtures, LEDs may be selected to provide various light colors to combine to produce light output with a high color rendering index (CRI). The desired color mixing may be achieved, for example, using blue, green, amber, red and/or red-orange LED chips. One or more of the chips may be in a package with a phosphor or may otherwise have a locally applied phosphor. For example a red LED may be combined with a blue LED and a yellow phosphor to provide a blue-shifted-yellow plus red color system. Translucent or transparent materials may be used with LED lighting fixtures to provide diffusion, color mixing, to otherwise direct the light, or to serve as an enclosure to protect the LEDs.

Rigid or semi-rigid materials may be included in a fixture or lamp as optical elements external to the LED modules themselves. Such optical elements may allow for localized mixing of colors, collimate light, and provide the minimum beam angle possible. Such optical elements may include reflectors, lenses, and/or lens plates. Reflectors can be, for example, of the metallic, mirrored type, in which light reflects from opaque silvered surfaces, or be made of or use white or near-white highly reflective material, or diffusive material. Reflectors can also made of or include a substrate made of plastic or metal coated with another material. Lenses can vary in complexity and level of optical effect, and can be or include traditional lenses, total internal reflection optics, or glass or plastic plates with or without coatings or additives.

SUMMARY

Embodiments of the present invention provide for a lighting system in which LEDs face, and the majority of light is incident on, a textured back reflector while producing minimal glare. Further, the reflector for the light fixture can be made from a material such as polycarbonate, which has a specular or semi-specular surface when the surface is smooth. Embodiments of the invention provide for a reflector that minimizes glare and imaging of the LED light source without the use of a costly diffuse white layer.

In example embodiments, a light fixture includes an LED light source to emit light, and a textured reflector to reflect the light. The textured reflector is configured to receive light from the LED light source in some embodiments so that at least 70% of the light is incident on the textured surface of the reflector. In some embodiments, at least 80% of the light is incident on the textured surface. In some embodiments, at least 90% or at least 95% of the light is incident on the textured surface. Such a system might be called a "retro-reflective" system or be described as "retro-reflecting" because very little to no light is directed straight from the light source into the illumination area. In some embodiments, the textured reflector is textured by way of an imprinted pattern. In some embodiments the reflector is extruded and the pattern can be imprinted as part of the extrusion process, either during or just after the reflector is shaped.

The reflector may be made of polycarbonate, or any other suitable material that would be at least semi-specular without texturing or with no texture present. In some embodiments, the imprinted pattern used to texture the reflector is a prismatic pattern. A textured reflector used in a retro-reflective application that uses a prismatic texturing pattern may be referred to as a prismatic retro-reflector. The pattern may vary spatially relative to the LED light source and/or the center of the reflector. In some embodiments, a light fixture using the textured reflector may be coextruded with a lens plate or lens plates.

In some embodiments, the texturing can be imparted to the reflector by roughening the interior surface of the reflector. As in the case of imprinting, polycarbonate can be used. Also as in the case of imprinting, the intensity of the roughening can vary spatially relative to the center of the reflector and/or the positioning of the LED light source. The roughening can be accomplished in a number of different ways, regardless of whether the reflector is initially made by extrusion or by some other method.

The reflector that is described herein can provide color mixing and reduce color hot spots and reflections in a light fixture that uses multiple color LEDs with or without lumiphors such as phosphors as a light source. As an example some fixtures include blue-shifted yellow plus red (BSY+R) LED systems, wherein the LED light source includes at least two groups of LEDs, wherein one group emits light having a dominant wavelength from 435 to 490 nm, and another group emits light having a dominant wavelength from 600 to 640 nm. In such a case, one group can be packaged with a phosphor, which, when excited, emits light having a dominant wavelength from 540 to 585 nm. In some embodiments, the first group emits light having a dominant wavelength from 440 to 480 nm, the second group emits light having a dominant wavelength from 605 to 630 nm, and the lumiphor emits light having a dominant wavelength from 560 to 580 nm.

A lighting system according to some example embodiments of the invention is operated by energizing an LED light source and directing at least 70% of light from the LED light source to be incident on the side of the reflector with the textured surface. In some embodiments, at least 80% of the light is incident on the textured surface, and in some embodiments at least 90% or at least 95% of the light is incident on the textured surface. At least a portion of the light incident on the reflector is directed into the illumination area. The although a large portion of the light from the LED light source is incident on the reflector, the amount reflected will vary based on the fixture design, as some fixtures may have opening to create "up-light" necessarily reducing the amount reflected into the illumination area.

BRIEF DESCRIPTION OF THE DRAWINGS

FIG. 6A is a broader view and FIG. 6B shows one prismatic element of the reflector.

FIG. 7A is a broader view and FIG. 7B shows one prismatic element of the reflector.

DETAILED DESCRIPTION

Figure 1:
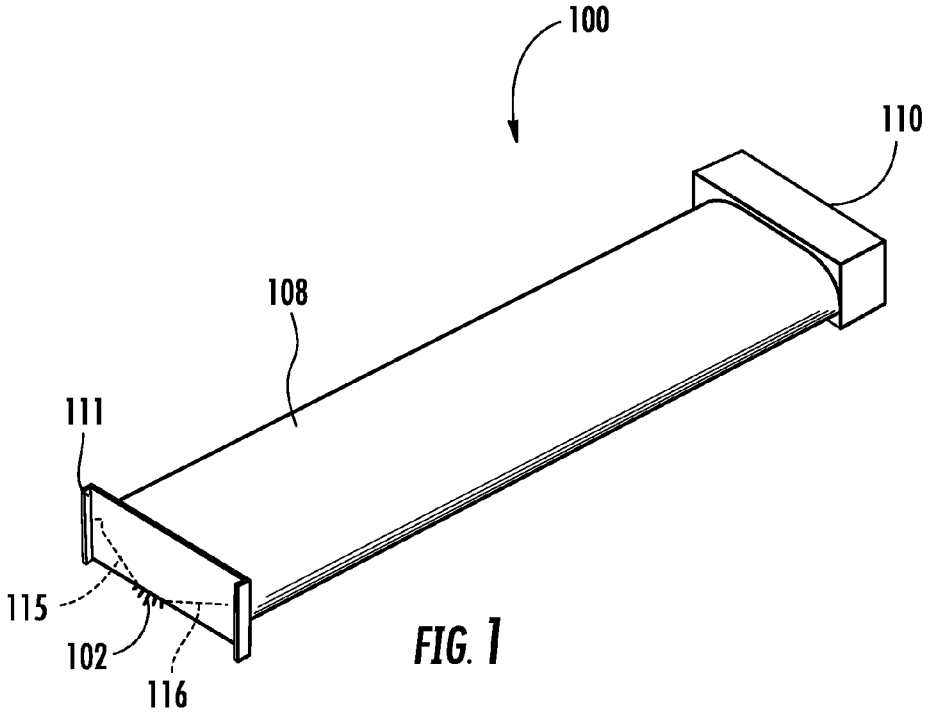
FIG. 1 is a top perspective view of a linear lighting system or linear light fixture according to at least some embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items. Also, when a process or method is described, the steps or sub-processes recited may be performed in any order or simultaneously, unless otherwise stated.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Reflections, glare and color hot spots are all possible concerns with LED lamps and fixtures. For example, strong glare and color hot spots sometimes occur because LEDs are closer to a point source of light than the source in other types of lighting products and multiple color devices are often used together to create substantially white light. Indirect LED lighting systems typically have their LEDs facing a back reflector, and the majority of the light from the LEDs is reflected from the back reflector before the light shines into the application area. This structure alleviates glare and provides color mixing when the back reflector is highly diffusive. However, highly reflective materials used for the back reflector can increase optical efficiency and reduce costs. Some highly reflective materials are also specular or semi-specular. A specular or semi-specular back reflector can image of LED light sources causing glare and/or color hot spots. In example embodiments of the invention, a back reflector is made from a material that is highly reflective and at least semi-specular, but the material is textured to reduce glare and imaging. The example fixtures described herein are LED lighting systems and the LEDs together can be referred to as an LED light source. However, lighting systems can take many forms and a lighting system according to an embodiment of the invention might be referred to by other terms such as a lamp, luminaire or a light panel, for example.

Embodiments of the invention can use a white, specular or semi-specular material such as polycarbonate (PC). Such a material can be extruded to produce the reflector, and the extruded part can provide both mechanical support and back reflection. Examples of PC material that can be used are FR6901, FR3030 from Bayer AG and BFL2000U from Sabic Innovative Plastics Holdings. In example embodiments of the invention, the material is textured in any of various ways. The material can be described as "at least semi-specular" when no texturing is present. A material is termed specular when a smooth surface of a structure made from the material is mirror-like, causing parallel light rays that are incident on the surface to reflect in parallel, with the result that humans perceive a reflected image in the surface of the material. A material is termed semi-specular when such light rays are only partially parallel, with the result that humans perceive a distorted image in the surface. If a material is at least semi-specular, humans can perceive anything in the surface from a much distorted, barely perceptible image to a perfect reflection, depending on the specifics of the material and the structure.

Note that specularity is not the same as reflectivity, which refers only to the total amount of light reflected from a surface, regardless of the cohesiveness of the reflected rays of light. However, the reflectivity of a reflector material can be significant in terms of the efficiency of a lighting system. The material used for reflective surfaces of reflectors for fixtures according to example embodiments of the invention can have a reflectivity of at least 90%, or least 95%, or in some cases, at least 97%.

As just one example of a textured reflector according to embodiments of the invention, thin extruded high reflectivity PC plates can have a pattern imprinted as part of the extrusion process, and the plates can be pressed onto an un-textured extruded PC back reflector substrate. Alternatively, the entire reflector can be extruded with an imprinted pattern on the inside or bottom surface of the reflector. Either type of imprinting can be accomplished with a textured drum as part of the extrusion process. A roughening pattern can also be applied by roughening a reflector or a plate to be pressed on to a reflector substrate with sand blasting, sanding, or another roughening technology.

Figure 2:
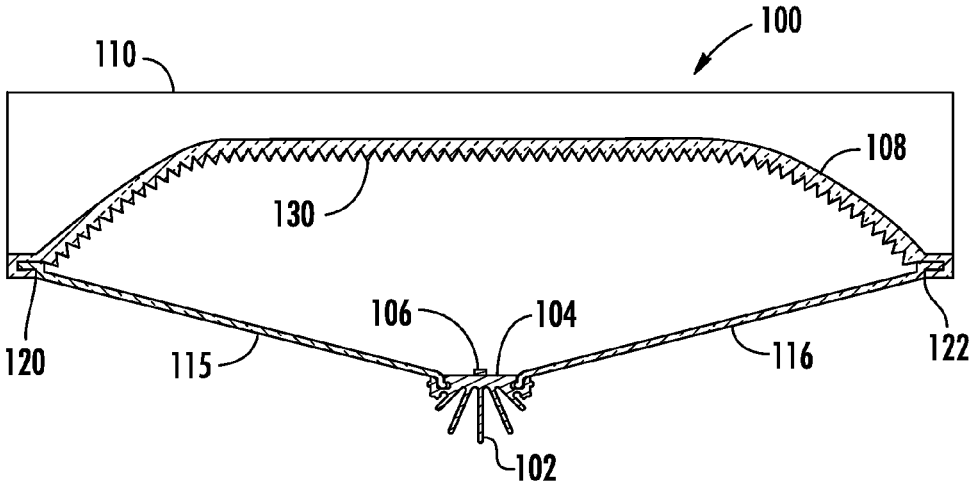
FIG. 2 is a cross-sectional view of the lighting system of FIG. 1.

FIG. 1 is a top perspective view of a light fixture 100, and FIG. 2 is a cross-sectional view of light fixture 100 according to example embodiments of the invention. Light fixture 100 is a linear fixture, which can be, as an example, a suspended linear light fixture. Light fixture 100 includes heatsink 102 having a mounting surface 104 on which LED packages or devices 106 can be mounted or fixed to collectively serve as a light source. Light fixture 100 also includes reflector 108 and end caps 110 and 111. End cap 110 is larger than end cap 111 and is shaped to act as a circuit box to house electronics used to drive and control the light source such as rectifiers, regulators, timing circuitry, and other components. The fixture illustrated in FIGS. 1 and 2 is designed to be suspended from a ceiling with chains or stanchions (not shown) but a similar troffer style fixture can also be designed to be installed in ceiling with appropriate materials.

In the example of FIGS. 1 and 2, reflector 108 includes a relatively flat region opposite the mounting surface of the heatsink; however, a reflector for a light fixture according to embodiments of the invention can take various shapes. For example, reflector 108 could be parabolic in shape, or include two or more parabolic regions. Light fixture 100 also includes two optional lens plates, 115 and 116, disposed at the sides of the heatsink. In the perspective view of FIG. 1 the outline of these lens plates is shown in dotted lines since the plates are not normally visible from this angle. In this particular embodiment, the lens plates and the reflector have been coextruded, resulting in a strong mechanical and/or chemical interlock at points 120 and 122. However, if such lens plates are used, they can be attached in other ways, including by being retained in channels formed with or in the reflector. Also visible in FIG. 2 is texturing 130 on the inside surface of reflector 108 facing LED devices 106. This texturing will be shown and describe in more detail later with respect to FIG. 4 through FIG. 7B. It should be noted that in FIG. 2 as well as in some of the other figures, the size and/or thickness of the texturing is not to scale and is exaggerated for clarity. Structures in any of the drawings may be sized to show detail without regard to the scale of a structure relative to other parts of a drawings or to parts shown in other drawings. Also, shapes may be exaggerated or simplified as appropriate for illustrative purposes. The drawings herein are for the most part intended to be schematic in nature and not necessarily literal representations.

Figure 3:
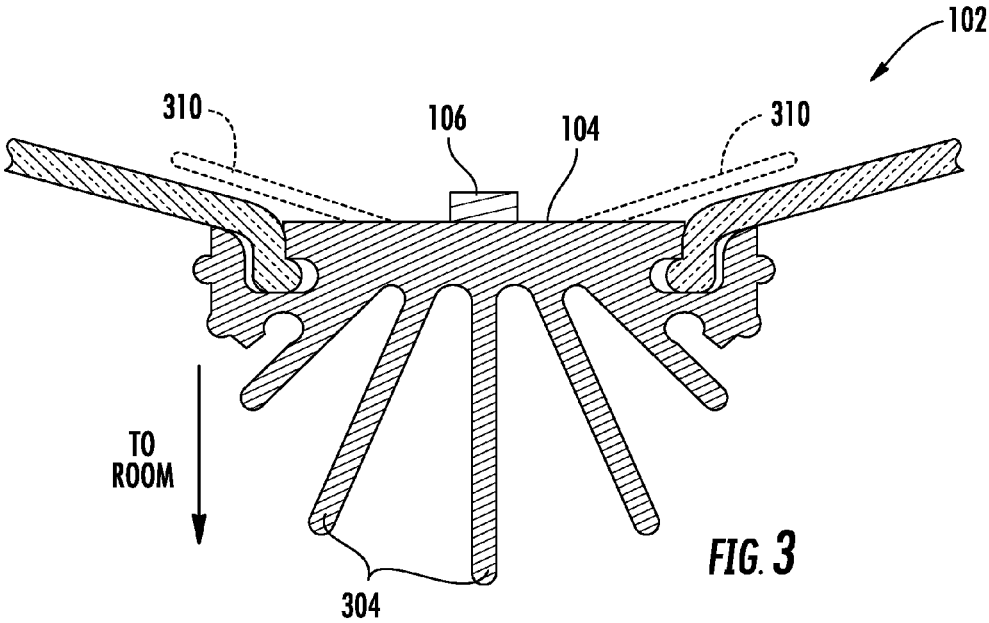
FIG. 3 is a cross-sectional view of the heatsink and light source for the light fixture of FIG. 1.

FIG. 3 is a close-up, cross-sectional view of the heatsink area of example light fixture 100 of FIG. 2, in which heatsink 102 and the light source are visible in some detail. It should be understood that FIG. 3 provides an example only as many different heatsink structures could be used with an embodiment of the present invention. The orientation of the heatsink relative to a room being illuminated is indicated. The topside portion of heatsink 102 faces the interior cavity of the light engine. Heatsink 102 includes fin structures 304 and mounting surface 104. The mounting surface 104 provides a substantially flat area on which LED devices 106 can be mounted for use as a light source. These LEDs can be mounted directly on the heatsink, depending on the material and provisions for wiring the LEDs. Alternatively, a metal core printed circuit board (PCB) can be mounted on the heatsink and the LEDs mounted on the PCB.

The LED devices 106 of FIGS. 2 and 3 can be mounted to face orthogonally to the mounting surface 104 to face the center region of the reflector, or they may be angled or tilted to face other portions of the reflector. In some embodiments, an optional baffle 310 (shown in dotted lines) may be included. The baffle 310 reduces the amount of light emitted from the LED light source at high angles that may escape the cavity of the light fixture without being reflected. Such baffling can help prevent hot spots or color spots visible when viewing the fixture at high viewing angles.

Figure 4:
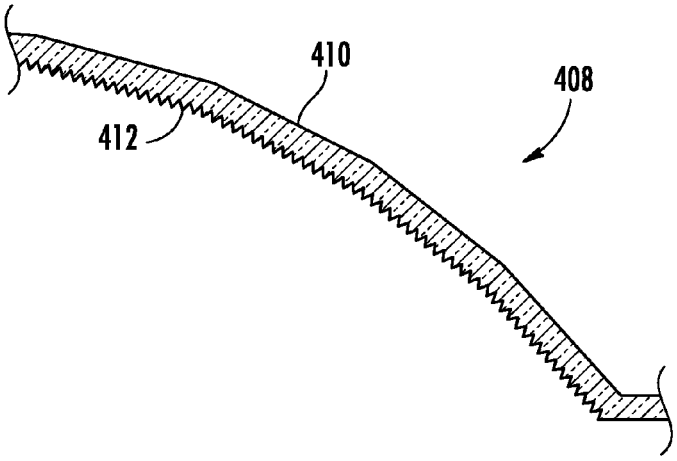
FIG. 4 is an enlarged cross-sectional view of a portion of the reflector for the lighting system of FIG. 1.

FIG. 4 is an enlarged cross-sectional view of a reflector 408 that can be used in a light fixture like the one illustrated in FIGS. 1 and 2. In this example, the polycarbonate material 410 is textured with an imprinted pattern 412. In this particular example the pattern is a prismatic pattern that will be further discussed below with respect to FIGS. 6A and 6B. Any other pattern could be used and prismatic patterns can vary greatly. Another example imprinted pattern is a cut keystone pattern.

Figure 5:
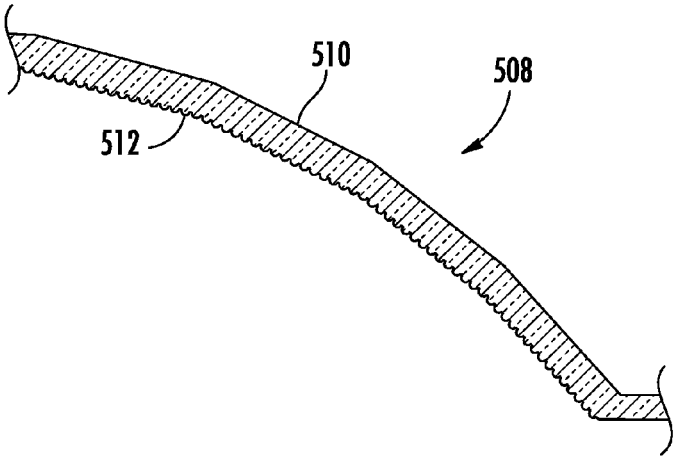
FIG. 5 is an enlarged cross-sectional view of a portion of a reflector for a light fixture according to additional embodiments of the present invention.

FIG. 5 is an enlarged cross-sectional view of a reflector 508 that can be used in a light fixture that the one illustrated in FIGS. 1 and 2. In this example, the polycarbonate material 510 is textured with a roughening pattern on surface 512. In this particular example, the pattern has been applied by sandblasting, but any number of other methods of creating a roughening pattern on the inside or downward facing surface of reflector 508 can be used. The amount of time spent roughening surface 512 as well as the size of character of any media used for roughening can be chosen to vary the amount, positioning and coarseness of the roughening pattern on the reflector.

Figure 6A:
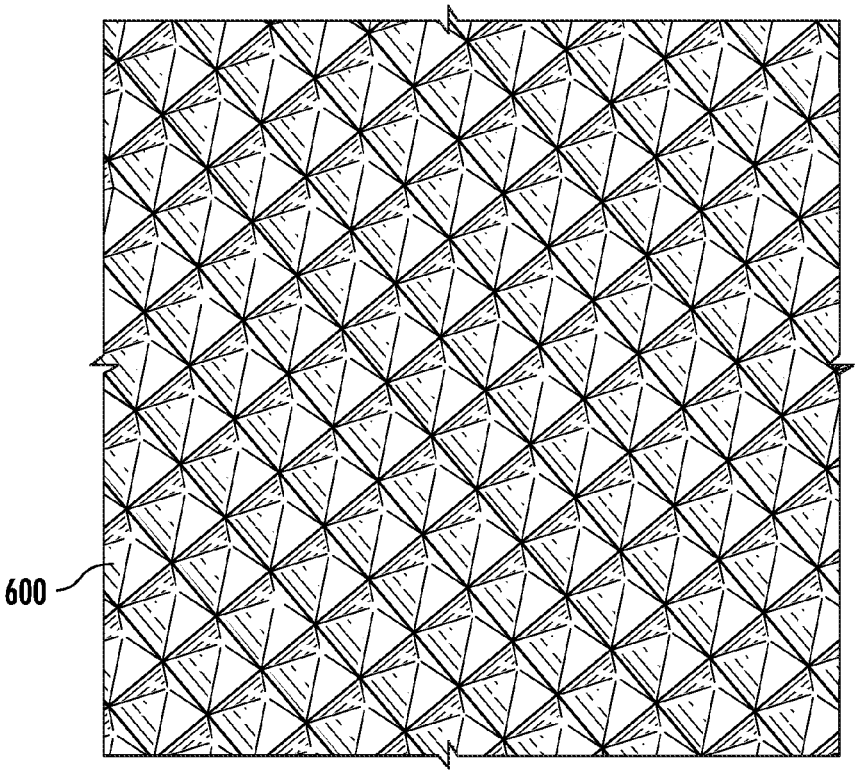
FIGS. 6A and 6B show enlarged perspective views of a portion of the reflector for the lighting system of FIG. 1.
Figure 6B:
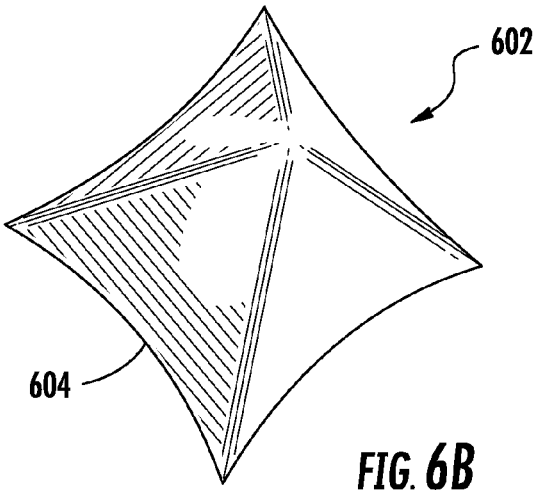

FIGS. 6A and 6B illustrate a type of prismatic pattern that can be applied to a reflector according to some embodiments of the invention. Section 600 of a reflector is shown in FIG. 6A and a single prismatic element 602 of the reflector is shown in FIG. 6B. This type of pattern, which includes repeated prismatic elements extending in all directions, is sometimes used in clear lens material. The "prism" has a curved edge 604 and the size of the prism in the pattern that is often specified by an "R" value, such as R9 or R20. In the example of FIGS. 6A and 6B, the "prism" extends into the reflector. Such a pattern may be referred to as a "female prismatic pattern." The prismatic elements could also be described as pyramidal in shape. In the case of FIGS. 6A and 6B, the "pyramids" have a rounded tip and soft, rounded edges.

Figure 7A:
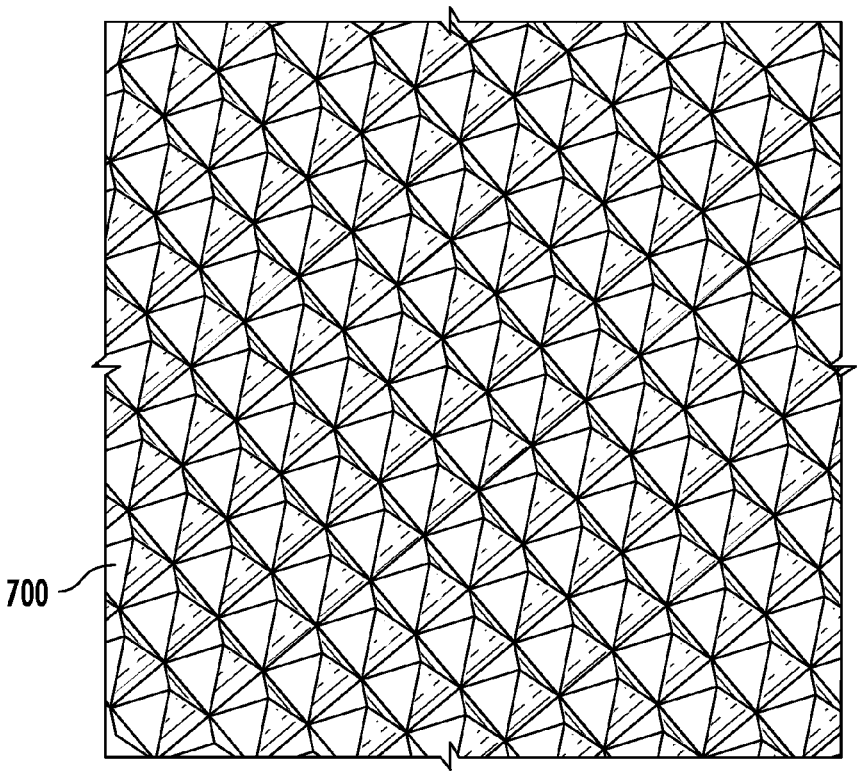
FIGS. 7A and 7B show enlarged perspective views of a portion of a reflector for a light fixture according to additional embodiments of the invention.
Figure 7B:
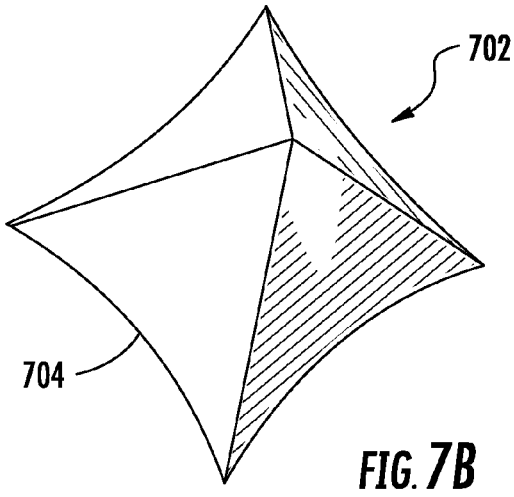

FIGS. 7A and 7B illustrate another type of prismatic pattern that can be applied to a reflector according to some embodiments of the invention. Section 700 of a reflector is shown in FIG. 7A and a single prismatic element 702 of the reflector is shown in FIG. 6B. This type of pattern, which includes repeated prismatic elements extending in all directions, is sometimes used in clear lens material. The prism again has a curved edge 704 that is often specified with an R-value. In the example of FIGS. 7A and 7B, the "prism" protrudes from the reflector. Such a pattern may be referred to as a "male prismatic pattern." The prismatic elements could also be described as pyramidal in shape. In the case of FIGS. 7A and 7B, the "pyramids" have a sharp tip and well-defined edges. It should be noted that these shapes are examples only, and an appropriate texture pattern might have any manner of edges, curves and the like. It should also be noted that a reflector for a retro-reflective system using a prismatic pattern may be referred to herein as a prismatic retro-reflector.

The example reflectors for light fixtures as described herein are configured relative to the LED light source so that at least 70% of the light from the source is incident on the reflector. In some embodiments, more light might be incident on the reflector, for example, at least 80%, at least 90% or at least 95%. The amount of this light actually reflected into the illumination area of the room where a fixture is used varies by system design. If the entire reflector surface is used to reflect the light, a very large portion of the light enters the room. However, embodiments of the invention can be used with reflectors that include diffusive lenses or lens plates, windows, or clear areas in the reflector itself to allow for up-lighting. In such a case only the actual reflective portions of the reflector need be textured according to example embodiments of the invention.

Figure 8:
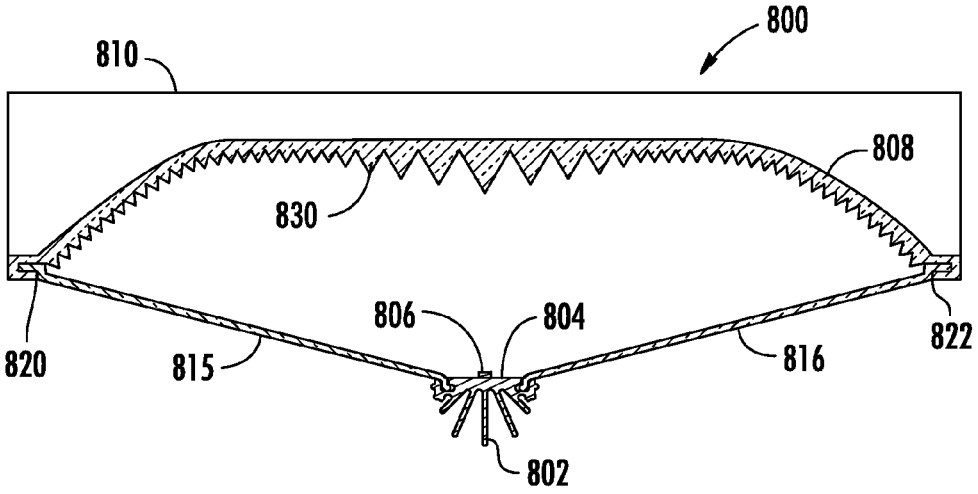
FIG. 8 is a cross-section view of a fixture according to example embodiments of the invention that is similar to that shown in FIGS. 1, 2 and 3, except that the reflector has a spatially varying texture. The fixture is also longer.

FIG. 8 is a cross-sectional view of light fixture 800 according to further example embodiments of the invention. Light fixture 800 is a linear fixture, which can be, as an example, a suspended linear light fixture, and is similar in most respects to the light fixture illustrated in FIGS. 1 and 2. Light fixture 800 includes heatsink 802 having a mounting surface 804 on which LED packages or devices 806 can be mounted or fixed to collectively serve as a light source. Light fixture 800 also includes reflector 808 and an end cap 810 is visible. The fixture illustrated in FIG. 8 is designed to be suspended from a ceiling with chains or stanchions (not shown) but a similar troffer style fixture can also be designed to be installed in ceiling with appropriate materials.

In the example of FIG. 8, reflector 808 again includes a relatively flat region opposite the mounting surface of the heatsink and includes spatially varying texturing; wherein the depth and/or frequency of an imprinted pattern 830 is/are increased in the flat region. Such texturing can be either imprinted, formed by roughening or created in some other way, but can still vary spatially, and may be said to spatially vary relative to the center of the reflector or the position of the LED light source. It is again noted that a reflector according to embodiments of the invention can take various shapes. Light fixture 800 also includes two optional lens plates, 815 and 816, disposed at the sides of the heatsink. Again in this embodiment, the lens plates and the reflector have been coextruded, resulting in a strong mechanical and/or chemical interlock at points 820 and 822. However, if such lens plates are used, they can also be retained in channels formed with the reflector or attached in some other way.

Figure 9A:
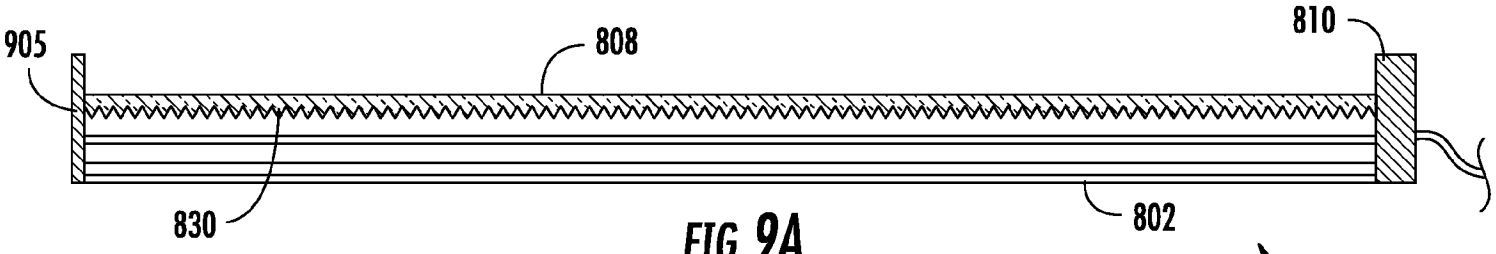
FIGS. 9A and 9B are a cross-sectional side view and a bottom view, respectively, of the light fixture of FIG. 8.
Figure 9B:
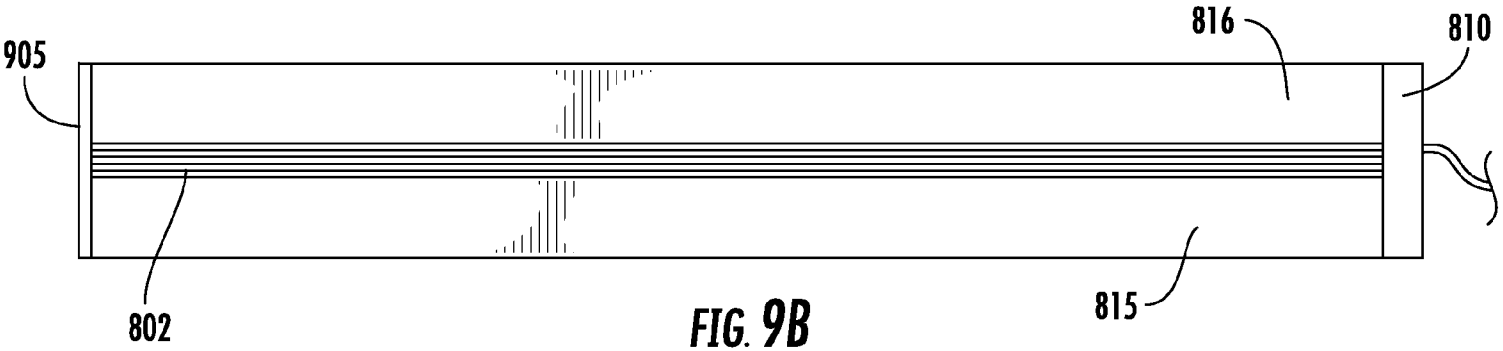

FIG. 9A is a cutaway side view of a linear light fixture 800 of FIG. 8, and FIG. 9B is a bottom view of light fixture 800. Again, fixture 800 is similar to the fixture shown in FIGS. 1 and 2. However, in the views of FIGS. 9A and 9B it can be seen to be longer. End caps 810 and 905 provide support for the fixture. End cap 810 is larger than end cap 905 and is shaped to act as a circuit box to house electronics used to drive and control the light sources such as rectifiers, regulators, timing circuitry, and other components. Wiring from the end cap/circuit box to the light sources can be passed through holes or slots in heatsink 802, or the LEDs can receive power through a metal core PCB mounted on the surface of the heatsink. If a PCB is used, a wiring harness from the end cap/circuit box can be connected to the PCB. Reflector 808 is visible in FIG. 9A, but is occluded from view by the lens plates 815 and 816, and heatsink 802. The bottom side of heatsink 802 exposed to the room environment. Also visible in FIG. 9A is the spatially varying textured inner surface 830 of reflector 808 according to example embodiments of the invention.

Figure 10A:
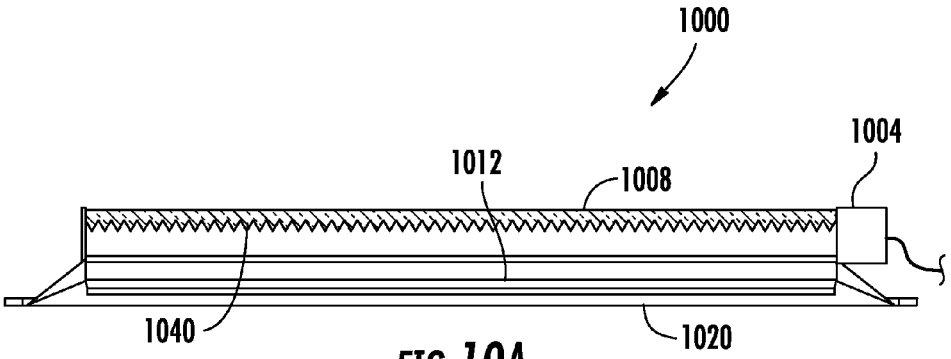
FIGS. 10A and 10B are a cross-sectional side view and a bottom view, respectively, of another light fixture according to example embodiments of the present invention. This fixture is similar to the one shown in FIGS. 1, 2 and 3, but includes a pan.
Figure 10B:
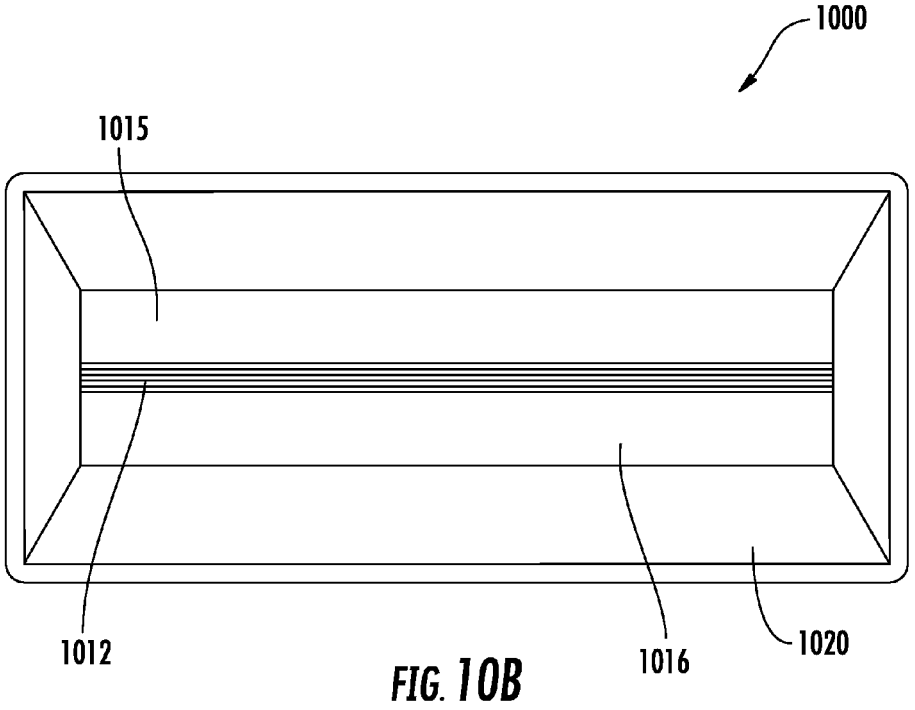

FIG. 10A is a cutaway side view of a light fixture 1000, and FIG. 10B is a bottom view of light fixture 1000. Circuit box 1004 is attached to the backside of the light fixture. Circuit box 1004 again houses electronics used to drive and control the light sources such as rectifiers, regulators, timing circuitry, and other components. Circuit box 1004 is attached to one end of reflector 1008. Wiring from the circuit box to the light sources can be passed through holes or slots in heat sink 1012, or the LEDs can receive power through a metal core PCB mounted on the surface of the heatsink. If a PCB is used, a wiring harness from the end cap/circuit box can be connected to the PCB. In FIG. 10B, the reflector 1008 is occluded from view by the lens plates 1015 and 1016 and the heatsink 1012. The bottom side of the heatsink 1012 is exposed to the room environment. Pan 1020 is sized to fit around the light engine and enable the fixture to be installed in a ceiling as a troffer, or simply to have a larger profile. Also visible in FIG. 10A is the inner surface 1040 of reflector 1008, which is textured according to example embodiments of the invention.

A multi-chip LED package used with an embodiment of the invention and can include light emitting diode chips that emit hues of light that, when mixed, are perceived in combination as white light. Phosphors can also be used. Blue or violet LEDs can be used in the LED devices and the appropriate phosphor can be deployed elsewhere within the fixture. LED devices can be used with phosphorized coatings packaged locally with the LEDs to create various colors of light. For example, blue-shifted yellow (BSY) LED devices can be used with a red phosphor on or in a carrier or on the reflector to create substantially white light, or combined with red emitting LED devices on the heatsink to create substantially white light. Such embodiments can produce light with a CRI of at least 70, at least 80, at least 90, or at least 95. By use of the term substantially white light, one could be referring to a chromacity diagram including a blackbody locus of points, where the point for the source falls within four, six or ten MacAdam ellipses of any point in the blackbody locus of points.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. Each of the former, blue LEDs are packaged with a phosphor that, when excited, emits light having a dominant wavelength from 560 to 580 nm, so as to form a blue-shifted-yellow LED device. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

The various parts of an LED fixture according to example embodiments of the invention can be made of any of various materials. Heatsinks can be made of metal or plastic, as can the various portions of the housings for the components of a fixture. A fixture according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lighting system comprising:

a textured, plastic reflector to reflect light, wherein the textured, plastic reflector includes a single surface comprising a substantially flat central region, a smooth transition to two parabolic regions on opposite sides of the relatively flat central region, and a plurality of pyramidal elements; and a plurality of LEDs to emit light, the plurality of LEDs positioned to face opposite an illumination area of a room so that at least 70% of the light is incident on the textured, plastic reflector and is reflected into the illumination area.

2. The lighting system of claim 1 wherein the pyramidal elements are imprinted.

3. The lighting system of claim 2 wherein the textured, plastic reflector further comprises polycarbonate.

4. The lighting system of claim 3 wherein the plurality of LEDs further comprises at least two groups of LEDs, wherein one group, if illuminated, would emit light having a dominant wavelength from 435 to 490 nm, and another group, if illuminated, would emit light having a dominant wavelength from 600 to 640nm, one group being packaged with a phosphor, which, when excited, emits light having a dominant wavelength from 540 to 585 nm.

5. The lighting system of claim 4 wherein the one group, if illuminated, would emit light having a dominant wavelength from 440 to 480 nm, and the other group, if illuminated, would emit light having a dominant wavelength from 605 to 630 nm, one group being packaged with a lumiphor, which, when excited, emits light having a dominant wavelength from 560 to 580 nm.

6. The lighting system of claim 3 further comprising at least one lens plate proximate to the plurality of LEDs.

7. The lighting system of claim 6 wherein the textured, plastic reflector and the at least one lens plate are coextruded.

8. The lighting system of claim 2 wherein the pyramidal elements spatially vary relative to at least one of the position of the plurality of LEDs and a center of the textured, plastic reflector.

9. The lighting system of claim 1 wherein the textured, plastic reflector further comprises a roughening pattern.

10. The lighting system of claim 9 wherein the textured, plastic reflector further comprises polycarbonate.

11. The lighting system of claim 10 wherein the plurality of LEDs further comprises at least two groups of LEDs, wherein one group, if illuminated, would emit light having a dominant wavelength from 435 to 490 nm, and another group, if illuminated, would emit light having a dominant wavelength from 600 to 640 nm, one group being packaged with a phosphor, which, when excited, emits light having a dominant wavelength from 540 to 585nm.

12. The lighting system of claim 11 wherein the one group, if illuminated, would emit light having a dominant wavelength from 440 to 480 nm, and the other group, if illuminated, would emit light having a dominant wavelength from 605 to 630 nm, one group being packaged with a lumiphor, which, when excited, emits light having a dominant wavelength from 560 to 580 nm.

13. The lighting system of claim 10 wherein the roughening pattern spatially varies relative to at least one of the position of the plurality of LEDs and a center of the textured, plastic reflector.

14. The lighting system of claim 10 further comprising at least one lens plate.

15. The lighting system of claim 14 wherein the textured, plastic reflector and the at least one lens plate are coextruded.

16. The lighting system of claim 1 wherein the plurality of pyramidal elements are disposed on the relatively flat, central region and each of the parabolic regions.

17. A method of making a light fixture, the method comprising:

assembling an LED light source comprising a plurality of LEDs;

extruding a reflector configured to receive light from the LED light source, the reflector being extruded from plastic and including a single surface comprising a substantially flat central region and a smooth transition to two parabolic regions on opposite sides of the relatively flat central region;

applying at least one texture to the reflector, the at least one texture including a plurality of pyramidal elements; and positioning the reflector and the LED light source in a fixture so that the plurality of LEDs face opposite an illumination area of a room and the reflector receives at least 70% of the light from the LED light source and reflects the light into the illumination area.

18. The method of claim 17 wherein the applying of the at least one texture to the reflector further comprises imprinting the pyramidal elements on the reflector.

19. The method of claim 18 wherein the imprinting of the reflector is accomplished while the reflector is being extruded.

20. The method of claim 18 wherein the imprinting of the reflector further comprises imprinting the reflector with a pattern that spatially varies relative to a center of the reflector.

21. The method of claim 17 wherein the plastic further comprises polycarbonate.

22. The method of claim 17 wherein the applying of the at least one texture to the reflector further comprises roughening an interior surface of the reflector.

23. The method of claim 22 wherein the extruding of the reflector further comprises extruding the reflector from polycarbonate.

24. The method of claim 23 wherein the roughening of the reflector further comprises roughening the reflector so that an imparted roughening of the surface spatially varies relative to a center of the reflector.

25. A textured reflector configured to receive at least 70% of light from a plurality of LEDs positioned to face opposite an illumination area of a room and reflect the light into the illumination area, the textured reflector further comprising plastic, a single surface including a substantially flat central region making a smooth transition to two parabolic regions on opposite sides of the substantially flat central region, and a plurality of pyramidal elements.

26. The textured reflector of claim 25 wherein the pyramidal elements are imprinted.

27. The textured reflector of claim 26 wherein the plastic comprises polycarbonate.

28. The textured reflector of claim 27 wherein the pyramidal elements spatially vary relative to a center of the reflector.

29. The textured reflector of claim 25 further comprising a roughened interior surface.

30. The textured reflector of claim 29 wherein the plastic comprises polycarbonate.

31. The textured reflector of claim 29 wherein a roughening of the interior surface spatially varies relative to a center of the reflector.

32. A method of retro-reflecting light into an illumination area, the method comprising:

energizing a plurality of LEDs facing opposite an illumination area of a room;

directing at least 70% of light from the LED light source to be incident on a single surface of a plastic reflector including texturing, a substantially flat central region and a smooth transition to two parabolic regions on opposite sides of the relatively flat central region, wherein the texturing comprises a plurality of pyramidal elements; and reflecting at least a portion of the light incident on the texturing into the illumination area.

33. The method of claim 32 wherein the texturing further comprises a roughened surface.

34. The method of claim 33 wherein the roughened surface varies relative to at least one of the LED light source and a center of the reflector.

35. The method of claim 32 wherein the pyramidal elements spatially vary relative to at least one of the LED light source and a center of the reflector.

36. The method of claim 32 wherein the energizing of the plurality of LEDs further comprises energizing at least two groups of LEDs, wherein one group, when illuminated, emits light having a dominant wavelength from 435 to 490 nm, and another group, when illuminated, emits light having a dominant wavelength from 600 to 640 nm, one group being packaged with a phosphor, which, when excited, emits light having a dominant wavelength from 540 to 585 nm.

37. A lighting system comprising:

a pyramidal, plastic, textured retro-reflector to reflect light into an illumination area of a room, the plastic, textured retro-reflector including a single surface comprising a substantially flat central region and a smooth transition to two parabolic regions on opposite sides of the relatively flat central region; and a plurality of LEDs to emit the light, positioned to face opposite the illumination area so that at least 70% of the light is incident on the pyramidal, plastic, textured retro-reflector.

38. The lighting system of claim 37 wherein the plastic, textured retro-reflector comprises polycarbonate.

39. The lighting system of claim 38 wherein the plurality of LEDs further comprises at least two groups of LEDs, wherein one group, if illuminated, would emit light having a dominant wavelength from 435 to 490 nm, and another group, if illuminated, would emit light having a dominant wavelength from 600 to 640 nm, one group being packaged with a phosphor, which, when excited, emits light having a dominant wavelength from 540 to 585 nm.

40. The lighting system of claim 39 wherein the one group, if illuminated, would emit light having a dominant wavelength from 440 to 480 nm, and the other group, if illuminated, would emit light having a dominant wavelength from 605 to 630 nm, one group being packaged with a lumiphor, which, when excited, emits light having a dominant wavelength from 560 to 580 nm.

41. The lighting system of claim 38 further comprising at least one lens plate proximate to the plurality of LEDs.

42. The lighting system of claim 41 wherein the plastic, textured retro-reflector and the at least one lens plate are coextruded.

43. The lighting system of claim 37 wherein the plastic, textured retro-reflector comprises a plurality of pyramidal elements that spatially vary relative to at least one of plurality of LEDs and a center of the pyramidal, plastic, textured retro-reflector.

44. The lighting system of claim 37 wherein a shape of the plastic, textured retro-reflector includes a smooth transition between the relatively flat, central region and each of the parabolic regions.

45. The lighting system of claim 44 wherein the plurality of LEDs further comprises at least two groups of LEDs, wherein one group, if illuminated, would emit light having a dominant wavelength from 435 to 490 nm, and another group, if illuminated, would emit light having a dominant wavelength from 600 to 640 nm, one group being packaged with a phosphor, which, when excited, emits light having a dominant wavelength from 540 to 585 nm.

46. The lighting system of claim 45 wherein the one group, if illuminated, would emit light having a dominant wavelength from 440 to 480 nm, and the other group, if illuminated, would emit light having a dominant wavelength from 605 to 630 nm, one group being packaged with a lumiphor, which, when excited, emits light having a dominant wavelength from 560 to 580 nm.

47. The lighting system of claim 37 further comprising a plurality of pyramidal elements disposed on the relatively flat, central region and each of the parabolic regions.

* * * * *